US012140141B1

(12) United States Patent
Wang et al.

(10) Patent No.: US 12,140,141 B1
(45) Date of Patent: Nov. 12, 2024

(54) ELECTRIC OIL PUMP INCLUDING PUMP HOUSING AND ECCENTRIC ASSEMBLY NON-CONCENTRICALLY ARRANGED WITH PUMP HOUSING

(71) Applicant: HANGZHOU QUADRANT TECHNOLOGY CO., LTD., Zhejiang (CN)

(72) Inventors: Liping Wang, Zhejiang (CN); Guojun Zhang, Zhejiang (CN); Ruinan Wang, Zhejiang (CN); Hezhao Hua, Zhejiang (CN); Yi Zhao, Zhejiang (CN); Zhixue Lu, Zhejiang (CN)

(73) Assignee: HANGZHOU QUADRANT TECHNOLOGY CO., LTD., Zhejiang (CN)

( * ) Notice: Subject to any disclaimer, the term of this patent is extended or adjusted under 35 U.S.C. 154(b) by 0 days.

(21) Appl. No.: 18/650,258

(22) Filed: Apr. 30, 2024

(51) Int. Cl.

| | |
|---|---|
| ***F04C 2/10*** | (2006.01) |
| ***F04C 2/07*** | (2006.01) |
| ***F04C 2/08*** | (2006.01) |
| ***F04C 15/00*** | (2006.01) |

(52) U.S. Cl.
CPC ..... *F04C 15/0065* (2013.01); *F04C 2/10* (2013.01); *F04C 2/101* (2013.01); *F04C 2/103* (2013.01); *F04C 2240/30* (2013.01); *F04C 2240/40* (2013.01); *F04C 2240/80* (2013.01)

(58) Field of Classification Search
CPC ..... F04C 15/0065; F04C 2/103; F04C 2/077; F04C 2/082; F04C 2/10; F04C 2/101
See application file for complete search history.

(56) References Cited

FOREIGN PATENT DOCUMENTS

| | | | | |
|---|---|---|---|---|
| DE | 112015001276 T5 * | 1/2017 | ..... | B60H 1/3222 |
| EP | 1674728 A2 * | 6/2006 | ..... | F04C 15/0034 |

OTHER PUBLICATIONS

English EP1674728 by PE2E Jun. 27, 2024.*
English DE 112015001276 by PE2E Jun. 27, 2024.*

* cited by examiner

*Primary Examiner* — Deming Wan
(74) *Attorney, Agent, or Firm* — Cooper Legal Group, LLC

(57) ABSTRACT

The present application discloses a high-precision electric oil pump, which relates to the technical field of new energy vehicles. The electric oil pump includes a pump housing connected with an outer gear and an inner gear engaged with each other, the pump housing is internally connected to a fixed shaft concentrically arranged with the pump housing, the outer gear is connected to the fixed shaft and concentrically arranged with the pump housing, the fixed shaft includes a connecting section, an eccentric calibrator is provided on an outer circumferential wall of the connecting section, the eccentric calibrator and the connecting section form an eccentric assembly, the inner gear is rotated around a geometric central axis of the eccentric assembly, and the eccentric assembly is non-concentrically arranged with the pump housing.

9 Claims, 8 Drawing Sheets

ELECTRIC OIL PUMP INCLUDING PUMP HOUSING AND ECCENTRIC ASSEMBLY NON-CONCENTRICALLY ARRANGED WITH PUMP HOUSING

TECHNICAL FIELD

The present application relates to the technical field of new energy vehicles, and, more particularly, to a high-precision electric oil pump.

BACKGROUND

With the rapid development of automotive electronics and new energy vehicles, integrated high-precision electric oil pumps are increasingly being applied due to their advantages of high efficiency, energy saving, and flexible control. In a traditional technology, an integrated electric oil pump mainly includes three components: a controller, a motor, and a gerotor, in which the gerotor includes a pump housing and a gear set. The gear set consists of an outer gear and an inner gear that are engaged with each other and located inside the pump housing. The inner gear is connected to the pump housing through a fixed shaft, and the inner gear is eccentric relative to the outer gear. The motor rotor is integrated with the outer gear, forming an assembly between the motor rotor and the gerotor. A circuit control module of the controller sends control signals to the motor. The electromagnetic force of the motor stator interacts with the permanent magnetic force of the motor rotor, driving the motor rotor to rotate. The assembly of the motor rotor and the gerotor rotate synchronously, and the outer gear drives the inner gear to rotate. There are several sealed intake-expulsion chambers formed by eccentric engagement between the inner gear and the outer gear. The inner gear and the outer gear are rotated in a preset direction, so that the volume of the sealed intake-expulsion chamber gradually increases and then decreases. In this way, the volume of oil pressed in and out of the sealed intake-expulsion chamber increases and decreases in a cyclic reciprocation manner. In addition, as the intake-expulsion chamber gradually increases, it is aligned with an inlet of the pump housing and communicates with it. As the intake-expulsion chamber gradually decreases, it is aligned with an outlet of the pump housing and communicates with it, thus forming an oil circuit inside the electric oil pump.

At present, in a conventional electric oil pump configuration, it has been encountering a serve issue of accuracy failure in controlling the concentricity among the among the fixed shaft center, the motor center and the pump housing center.

SUMMARY OF THE INVENTION

In view of this, a purpose of the present application is to provide a high-precision electric oil pump that can improve the control accuracy of concentricity among the among the fixed shaft center, the motor center the pump housing center.

An electric oil pump provided in the present application adopts the following technical solution.

On the one hand, the present application provides a high-precision electric oil pump, including a pump housing connected with an outer gear and an inner gear engaged each other, in which the pump housing is internally connected to a fixed shaft concentrically arranged with the pump housing, the outer gear is connected to the fixed shaft and concentrically arranged with the pump housing, the fixed shaft includes a connecting section, an eccentric calibrator is provided on an outer circumferential wall of the connecting section, the eccentric calibrator and the connecting section form an eccentric assembly, the inner gear is configured to be rotated around a geometric central axis of the eccentric assembly, and the eccentric assembly is non-concentrically arranged with the pump housing.

In the above technical solution, only one fixed shaft is provided inside the pump housing, and then an eccentric calibrator is arranged on the circumferential wall of the fixed shaft to form an eccentric assembly. The eccentric calibrator can compensate for the concentricity deviation caused by machining and assembling process of multiple components such as the pump housing, the fixed shaft, and the motor, effectively calibrating the concentricity among the fixed shaft center, the motor center, and the pump housing center. In this way, when the outer gear is rotatably connected to the fixed shaft, the eccentric assembly can also be rotatably connected to the inner gear, achieving coaxial but eccentric operation between the inner gear and the outer gear. In addition, due to the concentric arrangement of the fixed shaft and the pump housing, the motor center, the fixed shaft center and the pump housing center can ensure high concentricity by centering and press-fitting the fixed shaft into the bottom of the housing guided by an alignment feature, effectively compensating for insufficient concentricity accuracy caused by tolerance accumulation during assembling process.

Only one hole needs to be defined in the pump housing used for press-fitting the fixed shaft, which effectively reduces the machining complexity of the pump housing, improves the machining efficiency of the pump housing, and enhances the engagement accuracy between the outer gear and the inner gear.

Optionally, the eccentric calibrator is a crescent calibrator arranged on the outer circumferential wall of the fixed shaft, and the crescent calibrator is defined with a curved notch for insertion fitting the fixed shaft.

In the above technical solution, the circumferential side wall of the fixed shaft is partially insertion fit in the curved notch, forming an eccentric assembly rotatably connected to the inner gear with the outer circumferential wall of the crescent calibrator, achieving the effect of coaxially and eccentrically arranging the inner gear and the outer gear. This crescent calibrator effectively compensates the concentricity deviation between the motor center and the fixed shaft center, resulted from the stacking tolerance of multiple components during machining and assembling process, meanwhile, it helps to maintain the mutual driving between the inner gear and the outer gear based on a specific eccentricity design.

Optionally, the top end of the fixed shaft is press-fitting with a bearing, and the inner gear includes inner circumference to coaxially fit around with the fixed shaft against the eccentric assembly, and the motor rotor inner circumference is axially arranged to fit around the outer circumference of the outer gear. The upper part of the motor rotor, referring to a rotor neck, is provided with an inner circumference to press-fit with outer ring of the bearing, and the eccentric assembly is fit with the fixed shaft via the middle bushing, which is fitting with inner ring of the inner gear.

In the above technical solution, a conventional installation of the fixed shaft and the pump housing is achieved by designing a step at the housing bottom, where the fixed end of the fixed shaft is passed through the step and screwed with a nut which has thread inside. The nut is pressed against the end face of the step, to ensure a fixed connection between the fixed shaft and the pump housing through the screw locking and the mechanical friction provided by the nut and the step. However, the installation tightness of the nut can influence an axial end face clearance of the pump body. In a working condition, the temperature inside the pump housing will be increased, therefore, the axial end face clearance will be changed due to different thermal expansion coefficients of different component materials, such as aluminum material for pump housing, the stainless steel material for the shaft, and the steel material for the nut, these different material thermal expansion coefficients will, in turn, affect the pump performance contributed to the axial and radial clearance change. In the present application, the step and the nut in the pump housing have been eliminated. Therefore, a first end of the fixed shaft is passed through the hole at the housing bottom for press-fitting, and a second end of the shaft is tightly fit with the inner interference of the bearing. This design of two-end fitting can completely limit the insertion depth of the fixed shaft into the pump housing. This structural simplicity presented in the application effectively reduces and avoids the multiple interfaces and tolerance stacking, among multiple components including the shaft, the step and the nut in a traditional design. The fixed shaft directly fits through the bottom of the pump housing, eliminating the need of multiple components, and reduces the temperature impact on the pump axial and radial clearance due to different thermal expansion coefficients offered by multiple component materials as well, improving the pump efficiency.

The tight fitting between the inner circumference of the rotor neck of the motor rotor outer circumference and the outer circumference of the bearing can achieve the rotatory connection between the outer gear and the fixed shaft. The bushing, located between the crescent eccentric calibrator and the fixed shaft, can not only tighten the combination of the eccentric calibrator and the shaft, but also ensure the rotatory connection with the inner gear. The fitting between the outer circumferential wall of the bushing and the inner circumferential wall of the inner gear can achieve a rotational connection between the eccentric assembly and the inner gear.

A conventional rotational connection between the outer gear and the pump housing is achieved by tightly sleeving a larger radius bearing around the outer circumferential wall of the outer gear. The outer circumferential wall of the bearing is tightly fit inside the pump housing. However, due to a larger radius, the larger radius bearing tends to cause significant mechanical wear during operation and, in turn, a short service life of the bearing, and thus the larger radius bearing needs to be replaced frequently, which, however, affects the efficiency of the pump and increases a production cost. By adopting the tight fitting between the smaller radius bearing with the fixed shaft and the rotor neck, the present application effectively reduces mechanical friction, improves the working efficiency of the pump, and reduces the production cost.

Optionally, the inner circumference of the outer gear, the outer circumference of the motor rotor, and the inner gear are combined to form multiple intake-expulsion chambers. A volume of the intake-expulsion chamber first increases gradually and then decreases gradually along a rotation direction of the outer gear. The pump housing is defined with an inlet and an outlet. When the intake-expulsion chamber increases gradually, an open end of the intake-expulsion chamber is aligned with the inlet; and, when the intake-expulsion chamber decreases gradually, the open end of the intake-expulsion chamber is aligned with the outlet.

In the above technical solution, the inner circumferential wall of the outer gear, the outer circumference of the motor rotor, and the inner gear are combined to form multiple intake-expulsion chambers. When the inner gear and the outer gear are rotated relative to each other, the intake-expulsion chamber gradually increases in size and sucks in oil through the inlet. The amount of oil in the intake-expulsion chamber increases with the volume of the intake-expulsion chamber. During the suck-in process, due to the contact of the oil having a relatively low temperature with the teeth of the inner gear and the outer gear, the oil absorbs the heat from the teeth. When the intake-expulsion chamber gradually decreases in size, the oil in the intake-expulsion chamber is discharged through the outlet, so that the amount of oil in the intake-expulsion chamber decreases as the volume of the intake-expulsion chamber decreases. The oil with higher temperature after absorbing heat during the suck-in process is discharged from the outlet, achieving cooling and lubrication of the inner gear and the outer gear, and, in turn, cooling of the pump body, and ensuring the working temperature and efficiency of the pump.

Optionally, the pump housing is provided with a housing bottom covering the inlet and the outlet, the housing bottom is defined with a pressing hole fixedly connected to one end of the fixed shaft, the housing bottom is defined with an intake mouth communicating with the inlet and an expulsion mouth communicating with the outlet, the housing bottom is provided with a partition portion for separating the intake mouth and the expulsion mouth, and one side of the partition portion is attached to one side of the inner gear.

By adopting the above technical solution, the partition portion effectively separates the inlet from the outlet to ensure a contact time of the oil with the inner gear and the outer gear, and improve heat exchange and cooling effect. The fitting between one side of the partition portion and one side of the inner gear ensures a good sealing of the intake-expulsion chamber.

Optionally, one side of the crescent calibrator is defined with a location-guiding hole, and the housing bottom is defined with an assemble guiding hole corresponding to the location-guiding hole.

By adopting the above technical solution, for installing the inner gear and the outer gear, a pin shaft is fixed in the location-guiding hole and passed through the assemble guiding hole to achieve the positioning of the inner gear, which plays a guiding role for the installation of the fixed shaft, helps to improve the eccentricity errors of the inner gear and the outer gear, and improves the fitting accuracy between the inner gear and the outer gear.

Providing the location-guiding hole in the eccentric calibrator and the corresponding assemble guiding hole on a bottom boss of the pump housing decreases the eccentricity of the motor, the pump housing, and the fixed shaft caused by the accumulated machining and assembling tolerances of multiple components such as the motor, the shaft, the pump housing, and the gerotor. This effectively improves the air gap between the motor stator and the motor rotor and the radial gap of the pump body system, while improving the assembling accuracy of the inner gear and the outer gear.

Optionally, the pump housing is provided with a filter screen located at the inlet and covering the inlet.

By adopting the above technical solution, the filter screen can filter the oil passing through the inlet, reducing the impact of impurities in the oil on the operation of the pump.

Optionally, it further includes a motor rotor and a circuit control module, wherein the circuit control module includes a controller arranged in the pump housing, a busbar hub, and a motor stator arranged on the busbar hub, the motor stator is provided with multiple stator coils arranged along a circumference of the motor stator, the motor rotor is sleeved on an outer circumference of the outer gear, and an outer circumferential wall of the motor rotor corresponds to an inner circumferential wall of the motor stator.

By adopting the above technical solution, the circuit control module controls multiple stator coils to be energized, so as to generate a magnetic field which interacts with the permanent magnetic field of the motor rotor magnet to drive the motor rotor to rotate. The motor rotor is integrated on the outer gear, therefore, the interaction between the motor stator and the magnet of the motor rotor drives the outer gear to rotate. The outer gear drives the inner gear to rotate, achieving a relative rotation between the inner gear and the outer gear.

Optionally, an air gap is provided between the outer circumferential wall of the motor rotor and the inner circumferential wall of the motor stator.

By adopting the above technical solution, the reserved gap, also referred to as the air gap, reduces the contact between the motor rotor and the stator coils and, in turn, the friction force, facilitating the relative rotation of the outer gear and inner gear and reducing noise and vibration caused by friction. This design optimizes the geometric shape of the rotor magnet, reduces the air gap between the motor rotor and stator coils, and decreases the cogging torque and hysteresis during motor startup and commutation, achieving smoother motor rotation and reduced noise and vibration.

Optionally, the pump housing is provided with an inner housing for separating the controller and the busbar hub.

By adopting the above technical solution, the inner housing can separate the oil circuit and the electrical control section, improve sealing, and ensure that the controller can be operated at a suitable temperature.

In summary, the present application can achieve at least one of the following beneficial technical effects.

1. Only one fixed shaft is installed inside the pump housing, and then an eccentric calibrator is arranged on the circumferential wall of the fixed shaft to form an eccentric assembly. In this way, when the outer gear is rotatably connected to the fixed shaft, the eccentric assembly can also be rotatably connected to the inner gear, achieving coaxial but eccentric operation between the inner gear and the outer gear. This effectively compensates the concentricity deviation between the motor center and the fixed shaft center, resulted from the stacking tolerance of multiple components during machining and assembling process, meanwhile, it helps to maintain the mutual driving between the inner gear and the outer gear based on a specific eccentricity design;
2. For the installation of the fixed shaft and the pump housing, the step and the nut in the pump housing in a traditional pump housing have been eliminated in the present application. A first end of the fixed shaft is directly passed through the hole at the housing bottom for press-fitting, and a second end of the shaft is tightly fit with the inner interference of the bearing, so as to limit the insertion depth of the fixed shaft into the pump housing. This structural simplicity effectively reduces and avoids the multiple interfaces and tolerance stack, among multiple components including the shaft, the step and the nut in a traditional design. This also effectively reduces the temperature impact on the pump axial and radial clearance due to different thermal expansion coefficients offered by multiple component materials as well, improving the pump efficiency;
3. The tight fitting of the inner circumferential wall of the rotor neck of the outer gear outer circumference with the outer circumferential wall of the bearing can achieve a rotational connection between the outer gear and the fixed shaft. The bushing can not only tighten the combination of the eccentric calibrator and the fixed shaft, but also achieve the rotatory connection with the inner gear. The fitting between the outer circumferential wall of the bushing and the inner circumferential wall of the inner gear can achieve a rotational connection between the eccentric assembly and the inner gear;
4. For the connection of the outer gear with the pumping housing, by adopting the tight fitting between the smaller radius bearing with the fixed shaft and the rotor neck, the present application effectively reduces mechanical friction, improves the working efficiency of the pump, and reduces the production cost; and
5. For the installation of the inner gear and the outer gear, the positioning of the inner gear is achieved by fixing a pin shaft in the location-guiding hole and passing the pin shaft through the assemble guiding hole, which also plays a guiding role in the installation of the fixed shaft, helps to improve the eccentricity error of the inner gear and the outer gear, and improves the fitting accuracy between the inner gear and the outer gear. Providing the location-guiding hole in the eccentric calibrator and the corresponding assemble guiding hole on a bottom boss of the pump housing decreases the eccentricity of the motor, the pump housing, and the fixed shaft caused by the accumulated machining and assembling tolerances of multiple parts such as the motor, the shaft, the pump housing, and the gerotor. This effectively improves the air gap between the motor stator and the rotor and the radial gap of the pump body system, while improving the assembling accuracy of the inner gear and the outer gear.

DETAILED DESCRIPTION

The present application will be further explained in detail in conjunction with FIGS. 1 to 8. A high-precision electric oil pump is provided in some embodiments of the present application.

Figure 1:
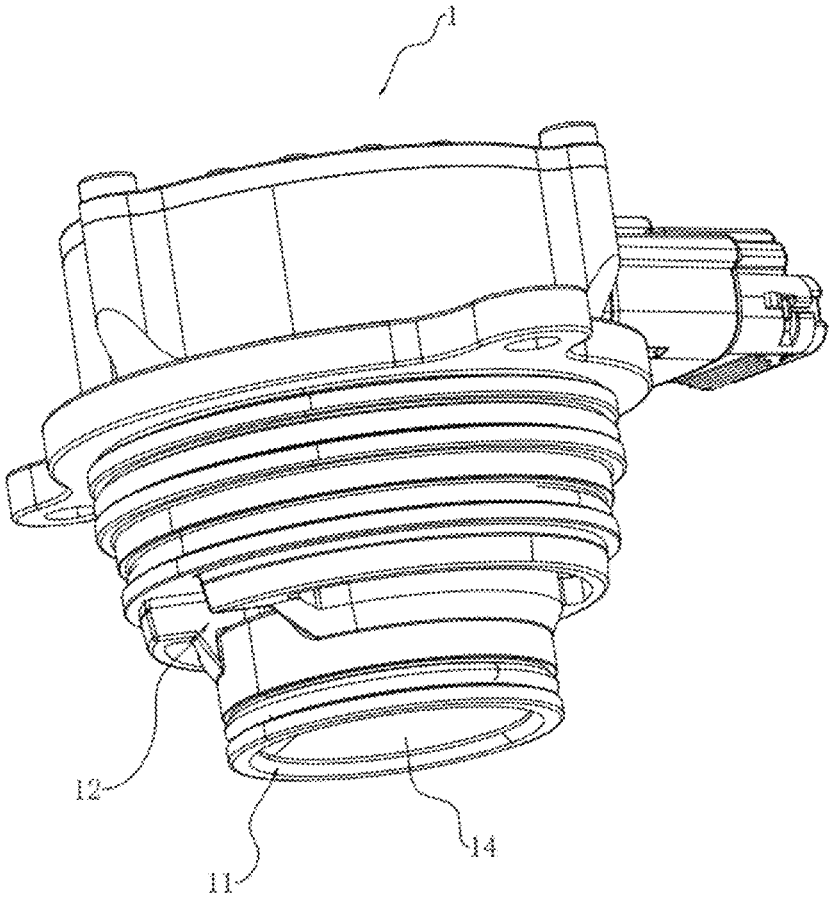
FIG. 1 is a schematic diagram of an overall structure of an embodiment of the present application.
Figure 2:
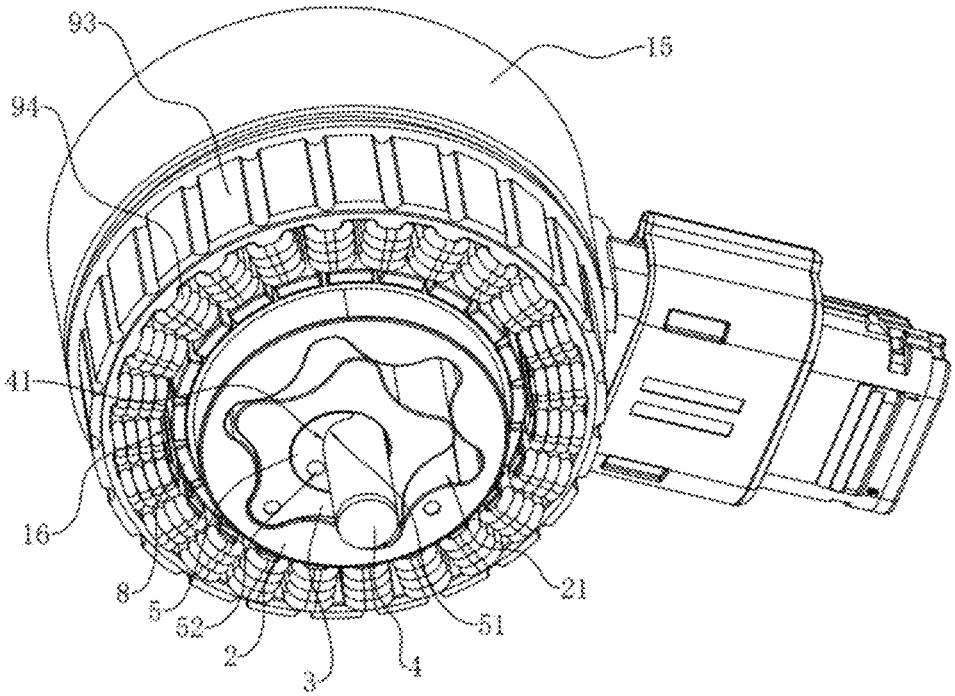
FIG. 2 is a schematic diagram of a circuit control module, an outer gear, and an inner gear of an embodiment of the present application.

Referring to FIGS. 1 and 2, a high-precision electric oil pump is shown, including a pump housing 1, a motor, a circuit control module 9, and a gear set. The motor includes a motor rotor 8, a motor stator 93, and stator coils 94. The motor stator 93 is fixed inside the pump housing 1, the motor rotor 8 is located inside the motor stator 93, and there are multiple groups of stator coils 94 arranged in a circular array around the motor stator 93, located between the motor rotor 8 and the motor stator 93.

In particular, the gear set includes an outer gear 2 integrated and fixed with the motor rotor 8, and an inner gear 3 located inside the outer gear 2 and engaged with inner teeth of the outer gear 2.

For operation, the circuit control module 9 controls multiple stator coils 94 to be energized, so as to generate a magnetic field which interacts with the permanent magnetic field of the motor rotor 8 magnet to drive the motor rotor 8 to rotate. The motor rotor 8 is fixed to the outer gear 2, therefore, the interaction between the motor stator 93 and the magnet of the motor rotor 8 drives the outer gear 2 to rotate. The outer gear 2 drives the inner gear 3 to rotate, achieving relative rotation between the inner gear 3 and the outer gear 2.

Figure 3:
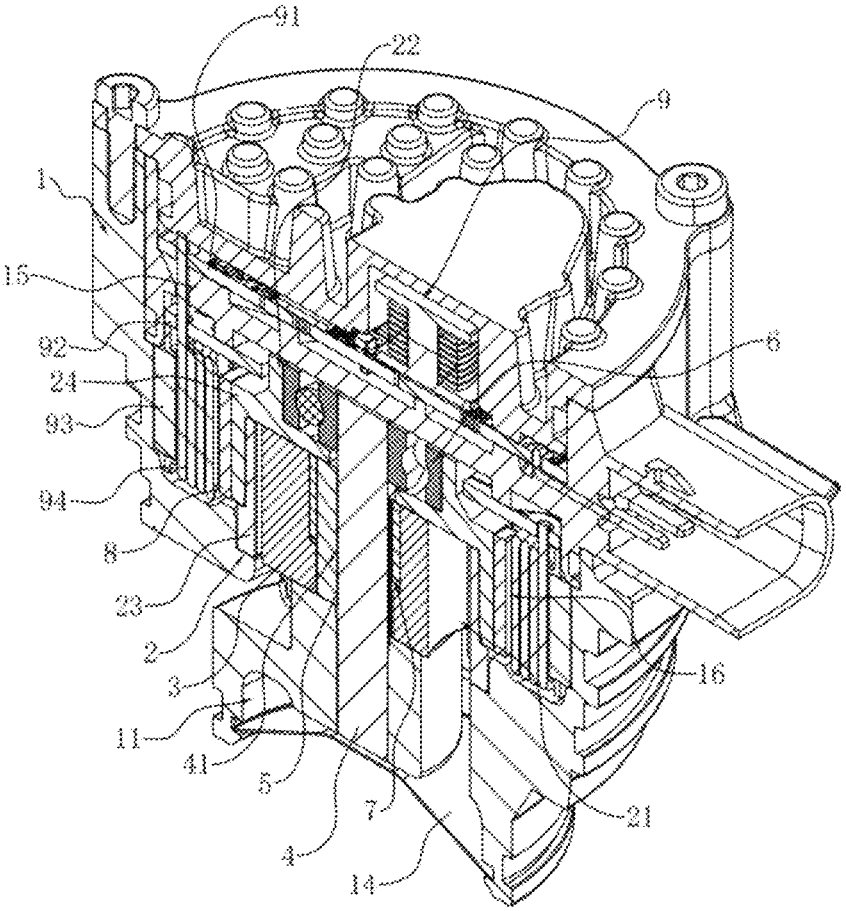
FIG. 3 is an overall schematic sectional diagram of an embodiment of the present application.
Figure 4:
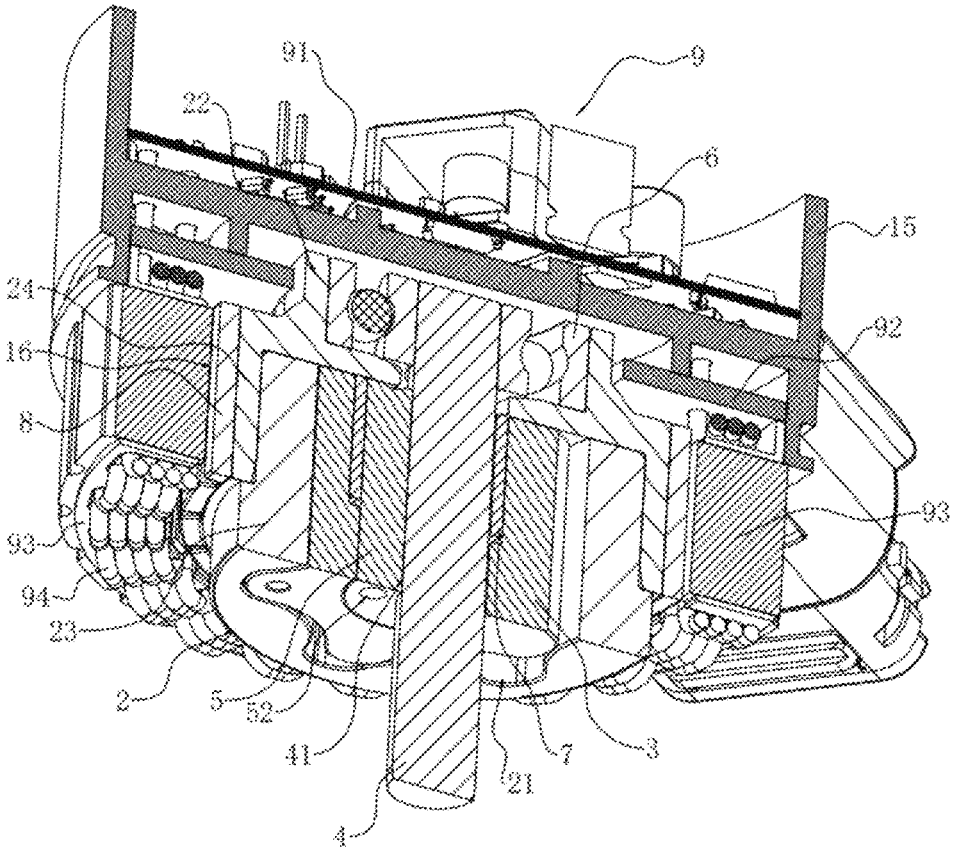
FIG. 4 is a partial sectional schematic diagram of an embodiment of the present application.

Referring to FIGS. 3 and 4, the circuit control module 9 includes a busbar hub 92 located inside the pump housing 1 and above the motor, and a controller 91 located above the busbar hub 92. The busbar hub 92 is configured to collect the incoming and outgoing wires of the stator coils 94, making the distribution of wires neat and clear, while allowing the wires to be welded on the busbar hub 92, providing a simple and clean process. Another role of busbar hub 92 is to separate the controller 91 from a motor section, so that oil only flows through the motor section, forming a cooling and lubrication circuit, without any oil entering the controller 91.

The outer gear 2 includes an inner circumference 23 of the outer gear 2 engaged with the inner gear 3, and a motor rotor inner circumference is fixedly sleeved around an outer gear outer circumference. The permanent magnet of motor rotor 8 is fixed on the outside of the outer circumference 24 of the motor rotor, and there is an air gap 16 provided between the permanent magnet of motor rotor 8 and stator coils 94. For the purpose of research and development, it is necessary to minimize the impact of various factors on the distance stability of the air gap 16. A top of the outer circumference 24 of the motor rotor is integrally formed with a rotor neck 22, and a bearing 6 is installed inside the rotor neck 22.

Figure 5:
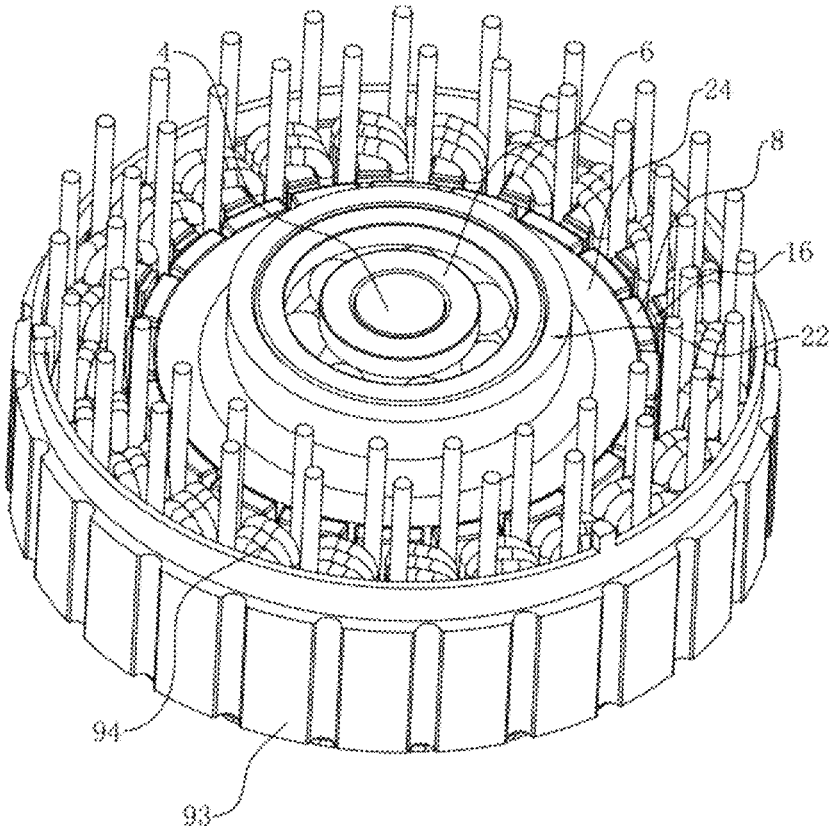
FIG. 5 is a schematic structural diagram of a motor stator of an embodiment of the present application.
Figure 6:
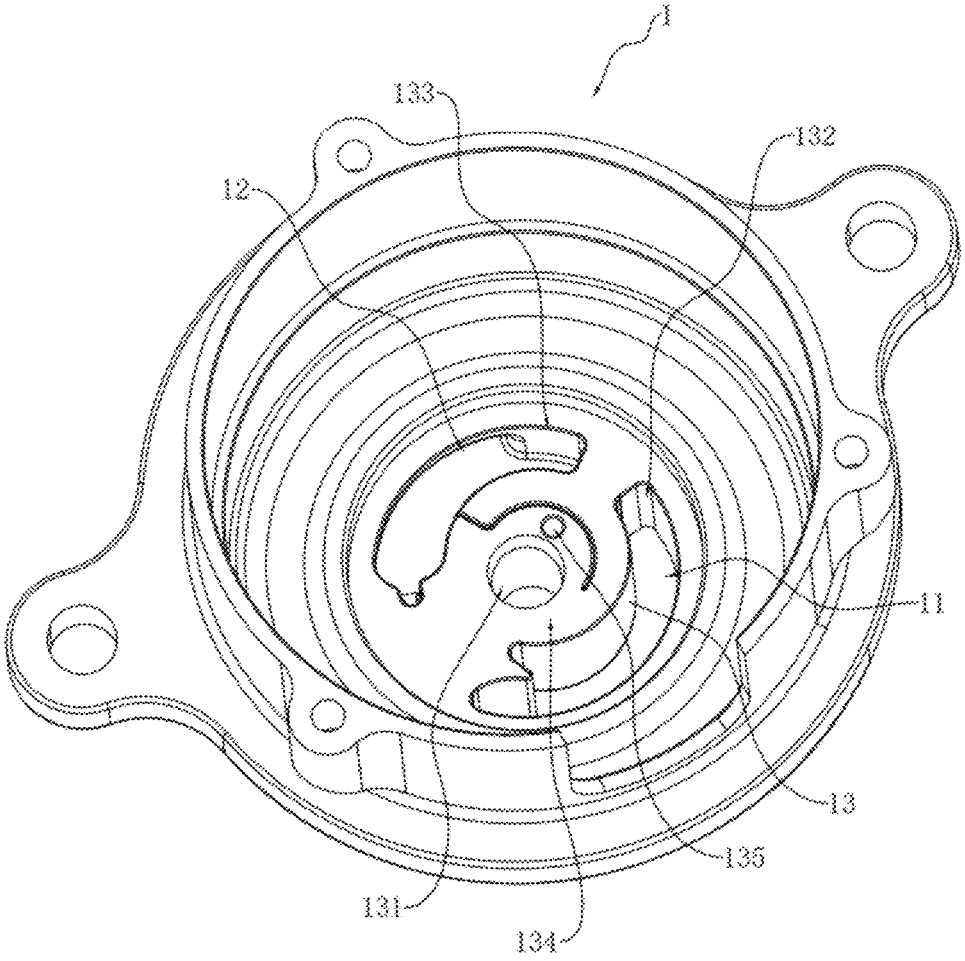
FIG. 6 is a schematic structural diagram of a bottom of a pump housing of an embodiment of the present application.

Referring to FIGS. 5 and 6, there is a pressing hole 131 defined in the housing bottom 13, which is concentric with pump housing 1. The pressing hole 131 is penetrated with a fixed shaft 4, which is tightly matched with the bearing 6. One side of the outer gear 2 is integrally formed with a rotor neck 22 matched with the bearing 6. The inner gear includes inner circumference to coaxially fit around with the fixed shaft against the eccentric assembly, and the motor rotor inner circumference is axially arranged to fit around the outer circumference of the outer gear. One side of the outer circumference 24 of the motor rotor is integrally formed with a rotor neck 22 matched with the bearing 6. The rotor neck 22 form an insertion groove with one side of the outer circumference 24 of the motor rotor for bearing 6 to be inserted. An outer circumferential wall of the bearing 6 is tightly matched with a circumferential groove wall of the insertion groove.

Figure 7:
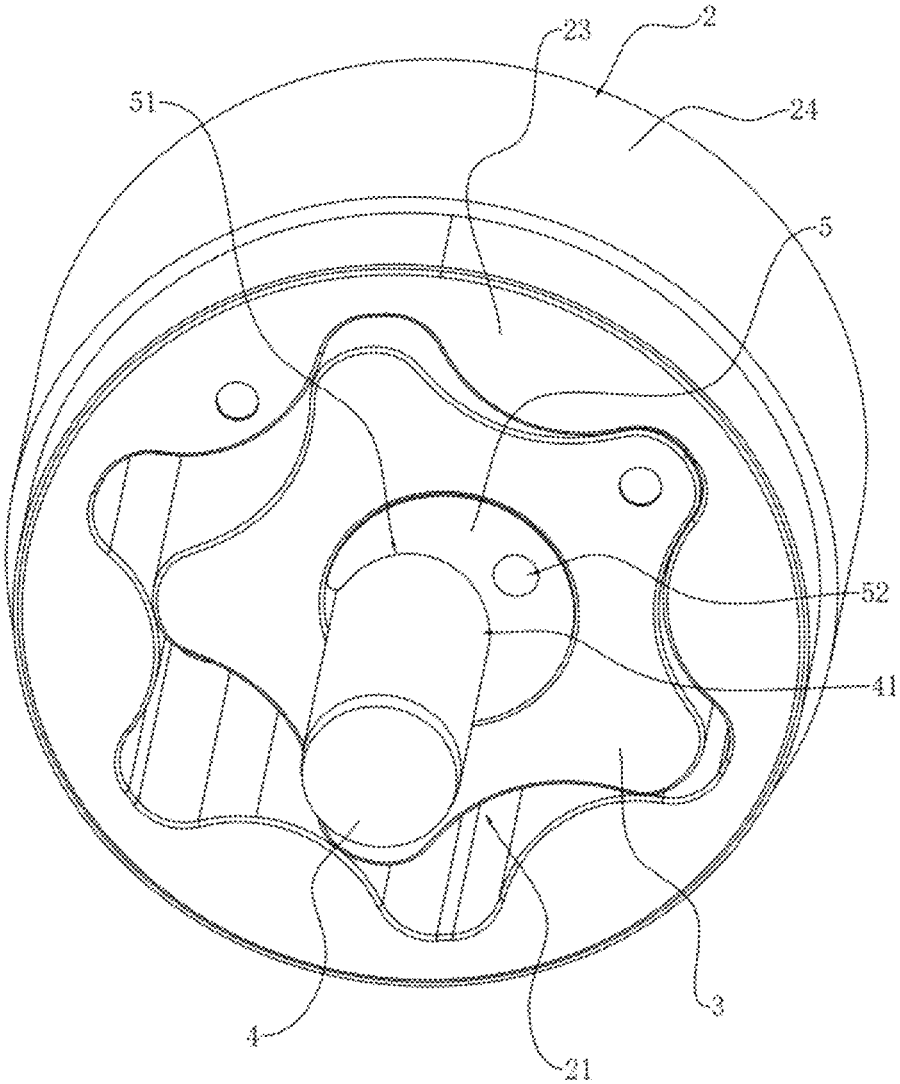
FIG. 7 is a schematic structural diagram of an outer gear and an inner gear of an embodiment of the present application.
Figure 8:
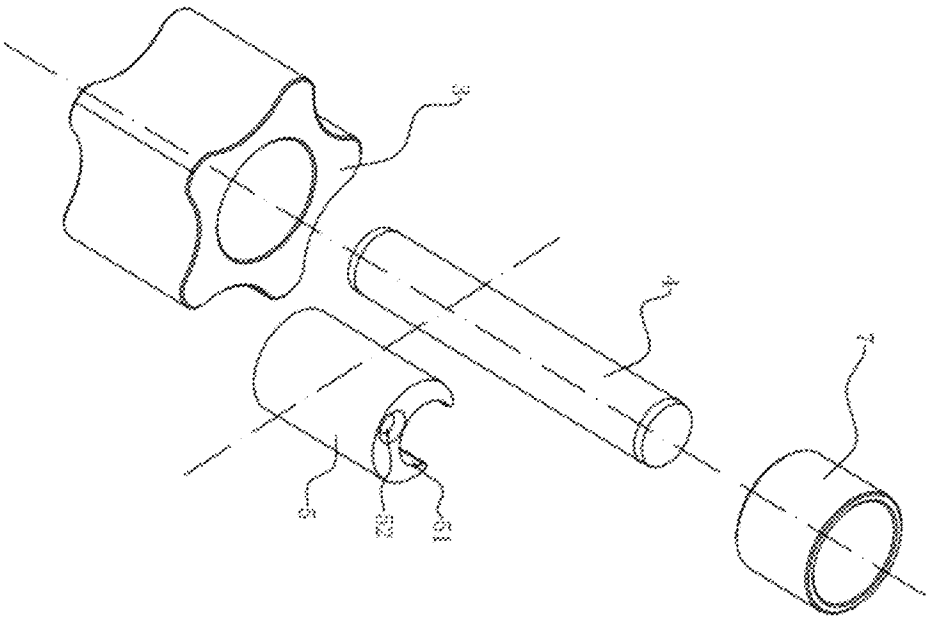
FIG. 8 is a schematic structural diagram of an eccentric calibrator of an embodiment of the present application.

Referring to FIG. 6-8, an inner circumferential wall of the inner circumference 23 of the outer gear and an outer circumferential wall of the inner gear 3 are both attached to an inner end face of the outer circumference 24 of the motor rotor. A zone between the outer gear 2 and the inner gear 3 is divided by tooth-to-tooth contact to form multiple closed intake-expulsion chambers 21, the volume of which gradually increases and then decreases along a rotation direction of the outer gear 2. A bottom of pump housing 1 is integrally formed with an inlet 11, and an outer circumferential wall of the pump housing 1 is integrally formed with an outlet 12. When the intake-expulsion chamber 21 gradually increases, it is aligned with the inlet 11. When the intake-expulsion chamber 21 gradually decreases, it is aligned with the outlet 12. The bottom of pump housing 1 has a filter screen 14 located at the inlet 11 and covering the inlet 11.

The bottom of pump housing 1 is integrally formed with a housing bottom 13 covering the inlet 11 and the outlet 12. An end face of housing bottom 13 is axially defined with a pressing hole 131 fixedly connected to one end of the fixed shaft 4. The fixed shaft 4 is inserted into the pressing hole 131, and an outer circumferential wall of fixed shaft 4 is tightly fit with the hole wall of the pressing hole 131. An end face of the housing bottom 13 is defined with an intake mouth 132 communicating with the inlet 11 and an expulsion mouth 133 communicating with the outlet 12. At the housing bottom 13, a partition portion 134 is formed to separate the intake mouth 132 and the expulsion mouth 133 after the intake mouth 132 and the expulsion mouth 133 are defined. One side of the partition portion 134 is attached to one side of the inner gear 3, improving the sealing between the intake mouth 132 and the expulsion mouth 133.

A location-guiding through hole 52 is defined in one side of a crescent calibrator, and an assemble guiding hole 135 corresponding to the location-guiding through hole 52 at the housing bottom 13. The assemble guiding hole 135 is eccentrically arranged with the pressing hole 131.

An implementation principle of a high-precision electric oil pump in an embodiment of the present application is as follows.

The fixed shaft 4 is arranged in the pump housing 1, and then the eccentric calibrator 5 is provided on a circumferential side wall of the fixed shaft 4 to form an eccentric assembly 41. This allows the outer gear 2 to be rotatably connect with the fixed shaft 4, while ensuring that the eccentric assembly 41 is also rotatably connected with the inner gear 3, achieving the effect of coaxial and eccentric operation of the inner gear 3 and the outer gear 2.

A hole is defined in the pump housing 1 that fits with the fixed shaft 4, effectively reducing the processing complexity of the pump housing 1, improving the processing efficiency of the pump housing 1, and improving the accuracy of the fit between the outer gear 2 and the inner gear 3.

The controller 91 controls the busbar hub 92 to energize multiple stator coils 94 on the motor stator 93. After the multiple stator coils 94 are energized, a magnetic field is generated to drive motor rotor 8 to rotate. The motor stator 93 drives the outer gear 2 to rotate, achieving a relative rotation between the outer gear 2 and the inner gear 3.

When the inner gear 3 and the outer gear 2 are rotated relative to each other, the intake-expulsion chamber 21 gradually increases in size and sucks in oil through the inlet 11, so that the amount of oil in the intake-expulsion chamber 21 increases with the volume of the intake-expulsion chamber 21. Due to a contact between the oil having a lower temperature and the teeth of the inner gear 3 and the outer gear 2 during the suck-in process, the oil absorbs the heat from the teeth. When the intake-expulsion chamber 21 gradually decreases in size, the oil in the intake-expulsion chamber 21 is discharged through the outlet 12, so that the amount of oil in the intake-expulsion chamber 21 decreases as the volume of the intake-expulsion chamber 21 decreases. The oil with higher temperature after absorbing heat during the suck-in process is discharged from the outlet 12, achieving cooling and lubrication of the inner gear 3 and the outer gear 2, and, in turn, cooling of the pump body.

The above are all preferred embodiments of the present application, not intended to limit the scope of protection of this application. Therefore, any equivalent changes made based on the structure, shape, and principle of the present application should be covered within the scope of protection of the present application.

LISTING OF REFERENCE SIGNS

1 Pump Housing
11 Inlet
12 Outlet
13 Housing Bottom
131 Pressing Hole
132 Intake Mouth
133 Expulsion Mouth
134 Partition Portion
135 Assemble Guiding Hole
14 Filter Screen
15 Inner housing
16 Air Gap
2 Outer gear
21 Intake-expulsion Chamber
22 Rotor Neck
23 Inner Circumference of Outer Gear
24 Outer Circumference of Rotor
3 Inner Gear
4 Fixed Shaft
41 Eccentric Assembly
Eccentric Calibrator
51 Curved Notch
52 Location-guiding Through Hole
6 Bearing
7 Bushing
8 Motor Rotor
9 Electrical Control Module
91 Controller
92 Busbar Hub
93 Motor Stator
94 Stator Coils

What is claimed is:

1. An electric oil pump, comprising a pump housing, wherein the pump housing is connected with an outer gear and an inner gear engaged each other, the pump housing is internally connected to a fixed shaft concentrically arranged with the pump housing, the outer gear is connected to the fixed shaft and concentrically arranged with the pump housing, the fixed shaft comprises a connecting section, an eccentric calibrator is provided on an outer circumferential wall of the connecting section, the eccentric calibrator and the connecting section form an eccentric assembly, the inner gear is rotated around a geometric central axis of the eccentric assembly, and the eccentric assembly is non-concentrically arranged with the pump housing;

wherein one end of the fixed shaft is press-fitted with a bearing, the inner gear comprises an inner circumference coaxially fit around with the fixed shaft against the eccentric assembly, an inner circumference of a motor rotor is axially arranged to fit around an outer circumference of the outer gear, an upper part of an outer circumference of the motor rotor is provided with an inner circumference to press-fit with an outer ring of the bearing, the eccentric assembly is fit with the fixed shaft via a bushing, and the inner gear is sleeved on the bushing.

2. The electric oil pump according to claim 1, wherein the eccentric calibrator is a crescent calibrator provided on the outer circumferential wall of the fixed shaft, and the crescent calibrator is defined with a curved notch for insertion fitting with the fixed shaft.

3. The electric oil pump according to claim 1, wherein an inner circumference of the outer gear, the outer circumference of the motor rotor, and the inner gear are combined to form multiple intake-expulsion chambers, a volume of the multiple intake-expulsion chambers first increases gradually and then decreases gradually along a rotation direction of the outer gear, and the pump housing is defined with an inlet and an outlet, when the multiple intake-expulsion chambers increase gradually, an open end of the multiple intake-expulsion chambers is aligned with the inlet, and when the multiple intake-expulsion chambers decrease gradually, the open end of the multiple intake-expulsion chambers is aligned with the outlet.

4. The electric oil pump according to claim 3, wherein the pump housing is provided with a housing bottom covering the inlet and the outlet, the housing bottom is defined with a pressing hole fixedly connected to the one end of the fixed shaft, the housing bottom is defined with an intake mouth in communication with the inlet and an expulsion mouth in communication with the outlet, the housing bottom is provided with a partition portion for separating the intake mouth and the expulsion mouth, and one side of the partition portion is attached to one side of the inner gear.

5. The electric oil pump according to claim 4, wherein the eccentric calibrator is a crescent calibrator, one side of the crescent calibrator is defined with a location-guiding hole, and the housing bottom is defined with an assemble guiding hole corresponding to the location-guiding hole.

6. The electric oil pump according to claim 3, wherein the pump housing is provided with a filter screen located at the inlet and covering the inlet.

7. The electric oil pump according to claim 1, further comprising a circuit control module, wherein the circuit control module comprises a controller arranged in the pump housing, a busbar hub, and a motor stator arranged on the busbar hub, the motor stator is provided with multiple stator coils arranged along a circumference of the motor stator, the motor rotor is sleeved on the outer circumference of the outer gear, and an outer circumferential wall of the motor rotor corresponds to an inner circumferential wall of the motor stator.

8. The electric oil pump according to claim 7, wherein an air gap is provided between the outer circumferential wall of the motor rotor and the inner circumferential wall of the motor stator.

9. The electric oil pump according to claim 7, wherein the pump housing is provided with an inner housing for separating the controller and the busbar hub.

* * * * *